US006474677B2

(12) United States Patent
Kasuya

(10) Patent No.: US 6,474,677 B2
(45) Date of Patent: Nov. 5, 2002

(54) IN-FLIGHT MEAL SERVICE CART

(75) Inventor: Toshihisa Kasuya, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 09/770,374

(22) Filed: Jan. 29, 2001

(65) Prior Publication Data

US 2001/0010419 A1 Aug. 2, 2001

(30) Foreign Application Priority Data

Jan. 31, 2000 (JP) ..... 2000-021188

(51) Int. Cl.[7] ..... B62B 1/04

(52) U.S. Cl. ..... 280/639; 280/47.34; 280/47.18; 312/249.1; 312/313; 108/115

(58) Field of Search ..... 312/249.1, 249.13, 312/249.11, 249.12, 313, 316; 296/22; 280/47.34, 47.35, 47.19, 639, 33.997, 47.18; 108/115

(56) References Cited

U.S. PATENT DOCUMENTS

| | | | | | |
|---|---|---|---|---|---|
| 2,004,296 | A | * | 6/1935 | Royce | 108/25 |
| 2,260,586 | A | | 10/1941 | Sheldon | |
| 2,661,258 | A | * | 12/1953 | Dinken | 108/79 |
| 2,851,700 | A | * | 9/1958 | Denison | 108/11 |
| 3,087,767 | A | * | 4/1963 | Schell | 5/93 |
| 3,873,114 | A | * | 3/1975 | Brown | 280/30 |
| 3,877,744 | A | | 4/1975 | Miller | 296/22 |
| 4,076,349 | A | * | 2/1978 | Gettlemen et al. | 312/236 |
| 5,224,531 | A | * | 7/1993 | Blohm | 108/110 |
| 5,480,170 | A | * | 1/1996 | Kaiser, II | 108/80 |
| 5,800,029 | A | * | 9/1998 | Robertson et al. | 108/38 |
| 6,068,356 | A | * | 5/2000 | Giuseppe | 280/47.35 |

FOREIGN PATENT DOCUMENTS

| | | | | |
|---|---|---|---|---|
| GB | 405167 | | 2/1934 | |
| JP | 406144233 A | * | 5/1994 | 280/79.11 |
| NL | 1002515 | | 9/1997 | |

* cited by examiner

*Primary Examiner*—Brian L. Johnson
*Assistant Examiner*—Kelly E Campbell
(74) *Attorney, Agent, or Firm*—Armstrong, Westerman & Hattori, LLP

(57) ABSTRACT

The object of the present invention is to provide a utility space without decreasing the space for passenger seats, by providing a utility function to a meal service cart and using the meal service cart after finishing the meal service as a bar counter.

An in-flight meal service cart 1 includes a box-shaped main body 10 forming a storage space therein, and a utility mechanism (a counter board) 20 equipped so as to be rotatable to the box-shaped main body. The counter board 20 is provided movably between a position of being stored on top of the ceiling board 13 of the main body, and a rotated position of being vertical to the side wall board 12, and when the counter board 20 is in the position of being vertical to the side wall board, it is supported by the opened front and rear doors 17 and 19 in a horizontal condition.

8 Claims, 7 Drawing Sheets

IN-FLIGHT MEAL SERVICE CART

FIELD OF THE INVENTION

The present invention relates to a meal service cart used in an aircraft.

DESCRIPTION OF THE RELATED ART

There are provided passenger seats, lavatory units, galley units and the like arranged in the small closed space inside an aircraft without any elbowroom left. Recently, with developments of engines or the like, aircrafts could fly for a longer period of time, so that demand for a utility space is increasing among users.

However, arranging an independent utility equipment inside such limited space in an aircraft leads to disadvantages such as decrease in passenger seat space, increase in overall weight and the like, so that passengers were unable to receive a satisfactory service.

On the other hand, the meal service for passengers in an aircraft is provided using a meal service cart. The meal service cart is stored to a predetermined storage space inside a galley when the meal service is finished.

The meal service cart has a height of approximately 1 meter, a height appropriate for providing drink service to an adult in a stand-up condition.

SUMMARY OF THE INVENTION

The present invention aims to provide a utility space without decreasing the space for passenger seats by providing a utility function to a meal service cart, and using the meal service cart after finishing the meal service as a bar counter.

The in-flight meal service cart of the present invention includes a box-shaped main body forming a storage space therein, and a utility mechanism equipped so as to be rotatable to the box-shaped main body. The utility mechanism is provided movably between a position of being stored to the main body and a rotated position of being vertical to the side wall board, and the box-shaped main body is provided with a supporting means for supporting the utility mechanism in a horizontal condition when the utility mechanism is in a position of being vertical to the side wall board.

The utility mechanism is a counter board, and is equipped on top of the ceiling board of the box-shaped main body, or is equipped so as to be inserted to the gap of the both side wall boards of the box-shaped main body comprised of two boards forming a gap in between.

The supporting means of the utility mechanism are front and rear doors, and the utility mechanism is supported in a horizontal condition by the front and rear doors in an opened position, when the utility mechanism is rotated to a position of being vertical to the side wall board. Or, the supporting means of the utility mechanism is a supporting post provided so as to be projected from said side wall board, and the utility mechanism is supported in a horizontal condition by the projected supporting post, when the utility mechanism is rotated to a position of being vertical to said side wall board.

Moreover, the outer surfaces of the box-shaped main body and outer surfaces of the utility mechanism being exposed during an equipped position are formed from a special fireproof material, and all of the outer wall surfaces of the meal service cart could disclose a special fireproof material at least during takeoff and landing of an aircraft.

DETAILED DESCRIPTION OF PREFERRED EMBODIMENTS

The embodiment of the present invention will now be explained with reference to drawings.

Embodiment 1

Figure 1:
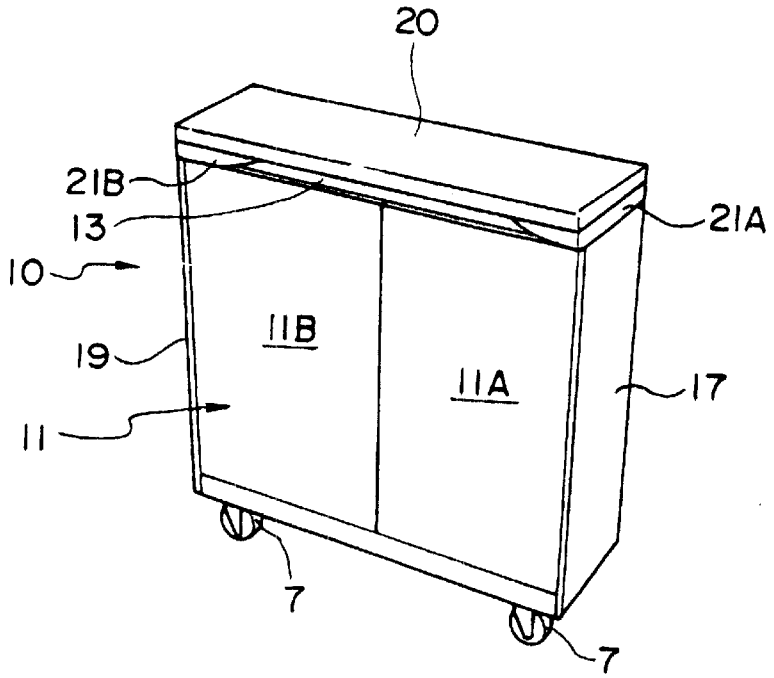
FIG. 1 is a perspective view of a meal service cart according to the present invention.
Figure 2:
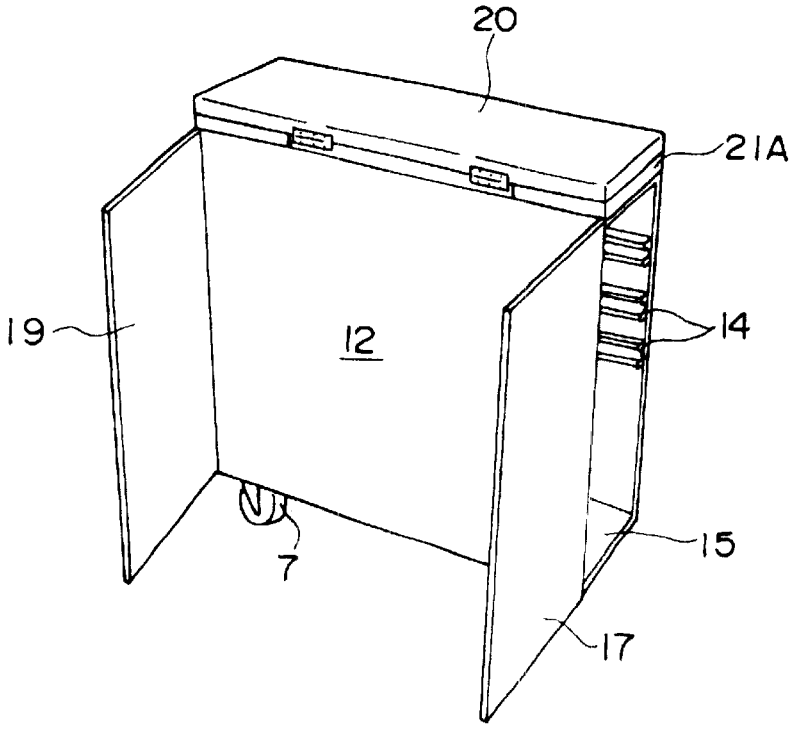
FIG. 2 is an explanatory view of a meal service cart with front and rear doors opened.
Figure 3:
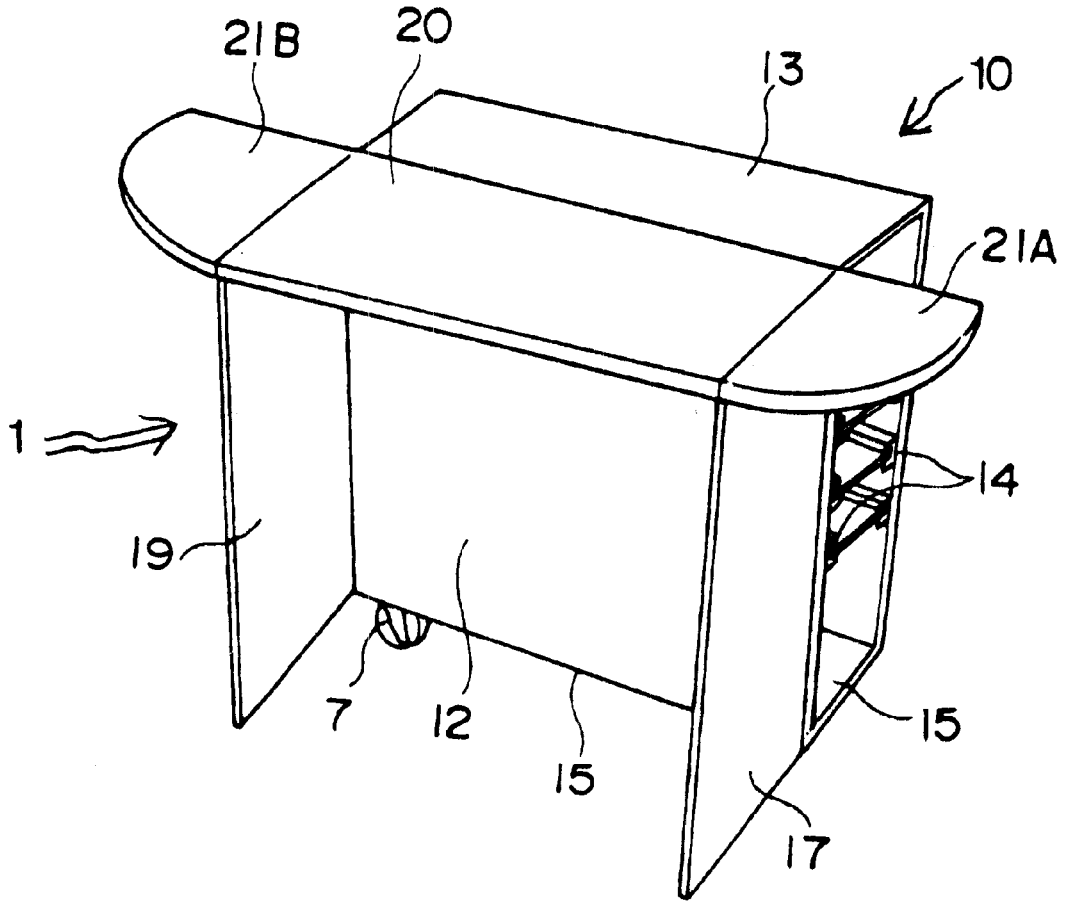
FIG. 3 is a perspective view of a meal service cart provided with a utility function.
Figure 4:
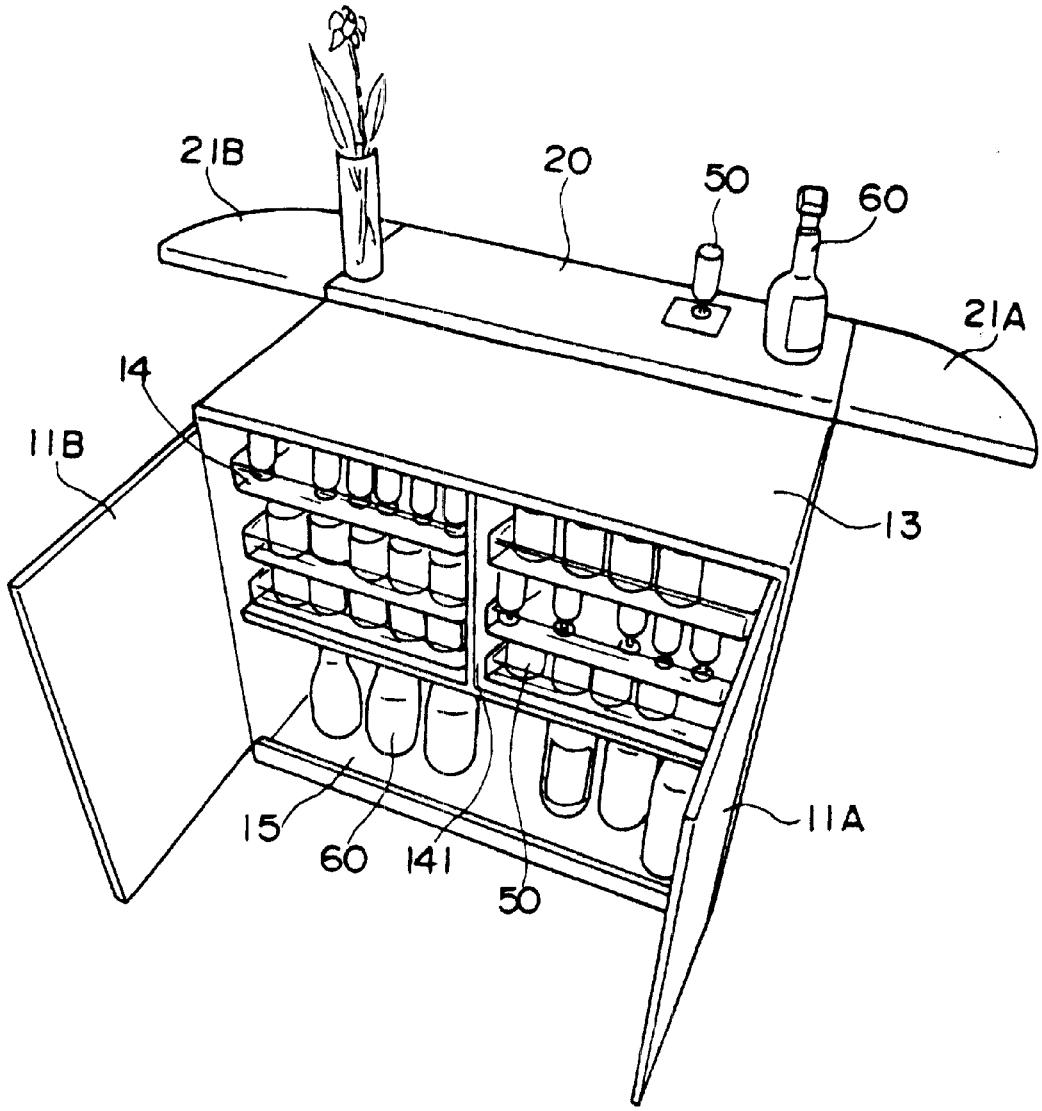
FIG. 4 is an overall view of a meal service cart used as a utility space.

FIG. 1 is a perspective view of a meal service cart according to Embodiment 1 of the present invention, FIGS. 2 and 3 are explanatory view of the composition, and FIG. 4 is an overall explanatory view in the case of using the meal service cart as a bar counter.

A meal service cart 1 is equipped with a box-shaped meal service cart main body 10 formed by assembling a first side wall board 11, a second side wall board 12 opposing to the first side wall board 11, a ceiling board 13, a bottom board 15, and a front door 17 and rear door 19, and a plurality of wheels 7 provided to the bottom board 15 for moving the meal service cart main body 10.

The meal service cart main body 10 is provided with a plurality of storage shelves 14 in parallel to the bottom board 15 for storing trays to the inner wall surfaces of the both side wall boards 11 and 12.

A counter board 20 as a utility mechanism member is placed on top of the ceiling board 13 of the meal service cart main body 10.

One side edge of the counter board 20 facing the second side wall board 12 is connected so as to be rotatable to the meal service cart main body 10.

To both ends of the counter board 20, there are connected extension counter boards 21A and 21B so as to be rotatable. Both extension counter boards 21A and 21B are stored on top of the ceiling board 13 in the folded condition, by rotating to the inner side of the counter board 20.

At least the outer surfaces of both side wall boards 11 and 12, front and rear doors 17 and 19, and the bottom board 15 composing the meal service cart 1, and at least the rear surface of the counter board 20, are formed from a special fireproof material satisfying the conditions regulated under flightworthy examination procedure, such as a composite material using phenol resin (honeycomb panel) and the like.

The first side wall board 11 is composed of two side wall boards 11A and 11B, so that when the side wall boards open to both sides, inside of the meal service cart 1 is exposed.

The storage shelves 14 arranged inside the meal service cart are provided with a partition board 141 at the center portion in the longitudinal direction, which forms a compartment wall of the trays inserted from the direction of the front door 17 and the trays inserted from the direction of the rear door 19.

Next, the usage of the meal service cart having composition as is mentioned above will be explained.

(1) Using the cart for meal service

The trays loaded with meal are stored inside the meal service cart main body 10 by placing them on the storage shelves 14, and the meal service cart 1 stored inside the galley is pulled out in the condition shown in FIG. 1 and moved along the passenger seats. The cabin attendant in the front opens the front door 17, pulls out the trays stored therein, and serves the meal. The cabin attendant in the rear opens the rear door 19, pulls out the trays stored therein, and serves the meal.

After completing the meal service, the meal service cart is stored in the predetermined place inside the galley.

(2) Forming a utility space

The meal service cart 1 after completing the meal service is placed in a stopped condition at a place for the utility space to be formed.

First, the front door 17 and the rear door 19 are opened (refer to FIG. 2).

Next, the counter board 20 is rotated so as to be placed on top of the front door 17 and the rear door 19. Then, the extension counter boards 21A and 21B are rotated to form one continuous board connected to the counter board 20.

The counter board 20 connected at both ends thereof with extension counter boards 21A and 21B is placed horizontally supported by the front door 17 and the rear door 19.

Moreover, dishes 50 such as plates, glasses or the like, and bottles 60 are stored to the storage shelves 14 inside the meal service cart main body 10.

That is, dishes 50 such as plates, glasses or the like and bottles 60 could be taken out by opening the first side wall boards 11A and 11B.

By using the counter boards 20 and 21 as a bar counter to serve drinks, food and the like, the location of the meal service cart 1 becomes a utility space.

The meal service cart shown in the present embodiment satisfies flightworthy examination procedure during takeoff and landing, because the rear surface of the counter board exposed to the outer surface during storage or meal service is composed of a material satisfying a special fireproof regulation applied to aircrafts. Also, when the meal service cart is used as a utility space, the surface provided with a material having decorative effect is used by rotating the counter board, therefore ideas for a utility space could be incorporated therein.

Embodiment 2

The embodiment is different from Embodiment 1 in that the arrangement of the counter board for bar counter differs.

Figure 5:
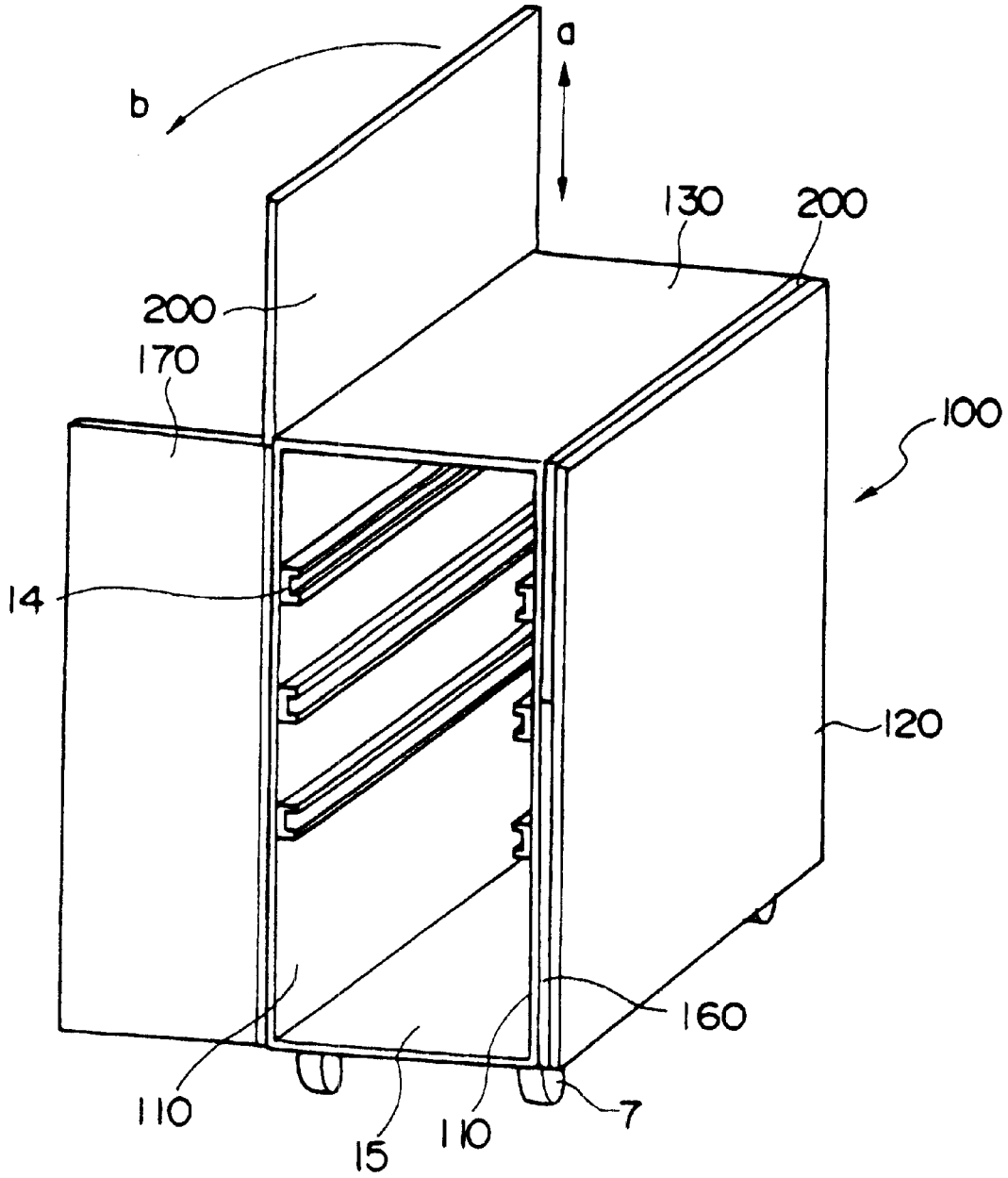
FIG. 5 is a perspective view of another embodiment according to the present invention.
Figure 6:
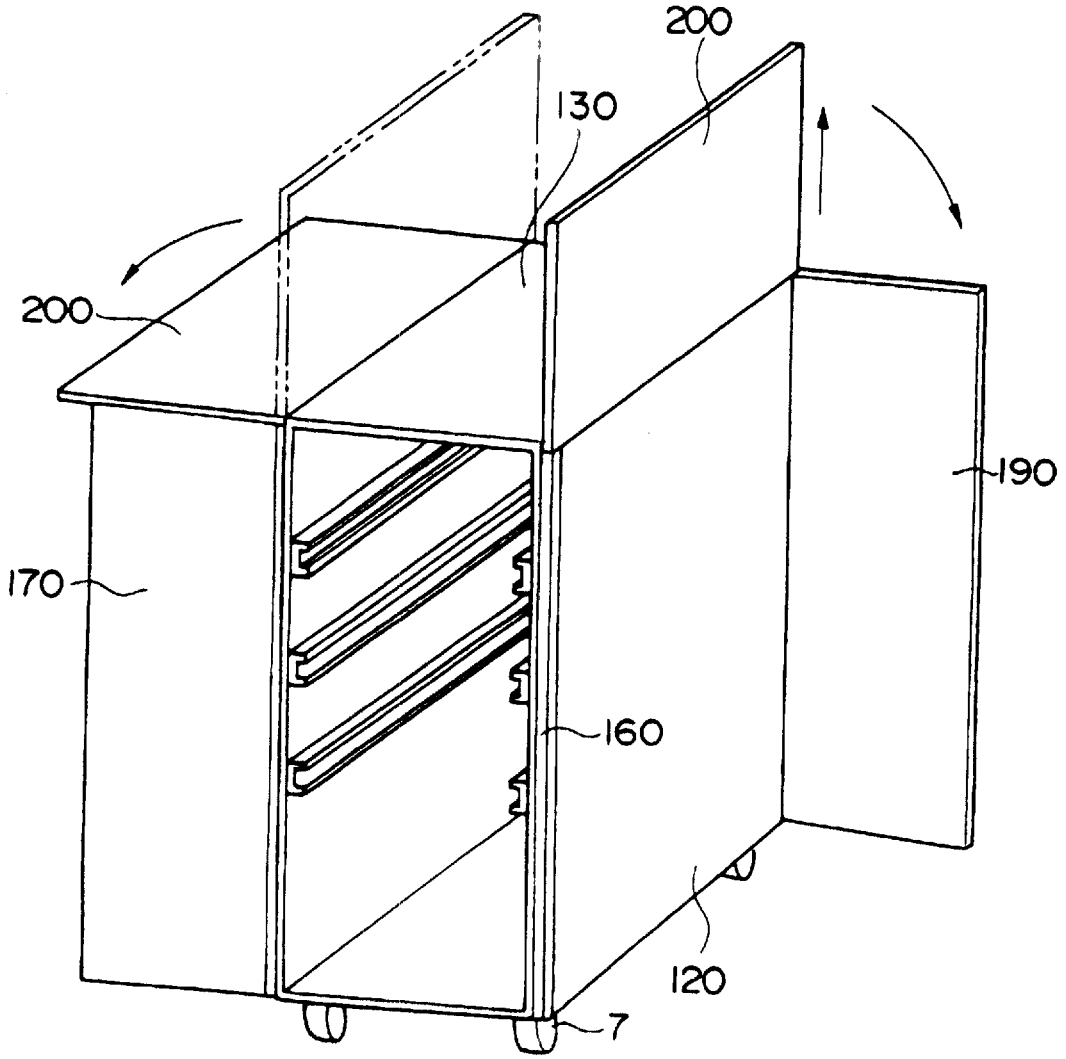
FIG. 6 is an explanatory view showing the operation.
Figure 7:
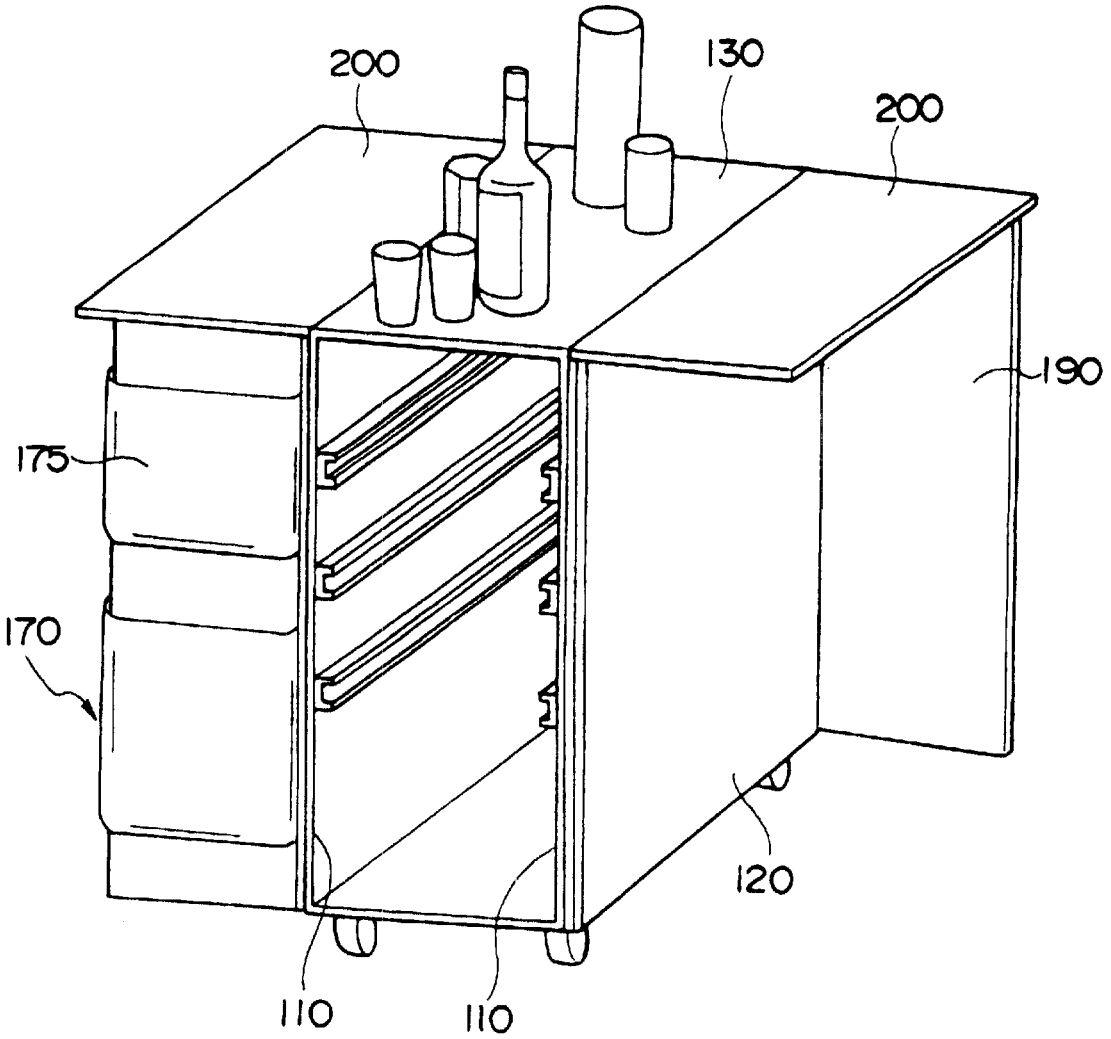
FIG. 7 is an overall view of another embodiment of a meal service cart used as a utility space.

FIGS. 5 and 6 are explanatory views of the composition of the meal service cart according to the present embodiment, and FIG. 7 is a perspective view of the meal service cart provided with a utility function.

The portions having the identical composition as in Embodiment 1 are allotted identical reference numbers, and the explanations thereof are omitted.

The meal service cart is equipped with a box-shaped main body 100 provided at the interior thereof with a plurality of storage shelves 14 for storing trays, and a plurality of transporting wheels 7.

The meal service cart 100 is a box-shaped body having a front door 170 and a rear door 190, and consisting of both side wall boards, a ceiling board 130 and a bottom board 15. The front door 170 and the rear door 190 have the composition of being opened by rotating in the direction opposite to each other.

The both side wall boards have the double composition of an inner wall board 110 and an outer wall board 120, and a gap 160 is formed between the inner wall board 110 and the outer wall board 120.

A counter board 200 is inserted in each of the gap 160 between the inner wall board 110 and the outer wall board 120. The counter board 200 is movable in the direction of arrow a along the inner and outer wall surfaces, and is basically stored inside the gap 160.

At least the outer surfaces of the outer wall surfaces 120, the ceiling board 130, the front door 170, the rear door 190, and the bottom board 15 of the meal service cart main body 100 of the meal service cart are formed from a special fireproof material satisfying the conditions regulated in flightworthy examination procedure, such as a composite material using phenol resin (honeycomb panel) and the like.

The usage of the meal service cart thus composed will be explained.

When providing a utility function

First, the front door 170 and the rear door 190 are opened. At this point, the front and rear doors are opened in the opposite directions, such as opening the front door 170 to the right and the rear door 190 to the left, as is shown in FIG. 6.

Next, the stored counter board 200 is pulled out. It is then rotated in the direction of arrow b and is rested on the front door 170. Similarly, the other counter board 200 is rested on the rear door 190.

Needless to say, glasses, bottles and the like may be stored inside the meal service cart main body 100, and a storage portion 175 may be provided to the inner side wall surfaces of the front and rear doors 170 and 190.

The counter boards of the meal service cart according to the present embodiment are stored the inside the meal service cart, so that there is no need to satisfy a special fireproof regulation applied to the interior decorations of an aircraft, and materials having decorative effect could be used, so that ideas for a utility space could be incorporated therein.

The meal service cart could form a utility space without decreasing the number of passenger seats, or increasing the overall weight.

Figure 8:
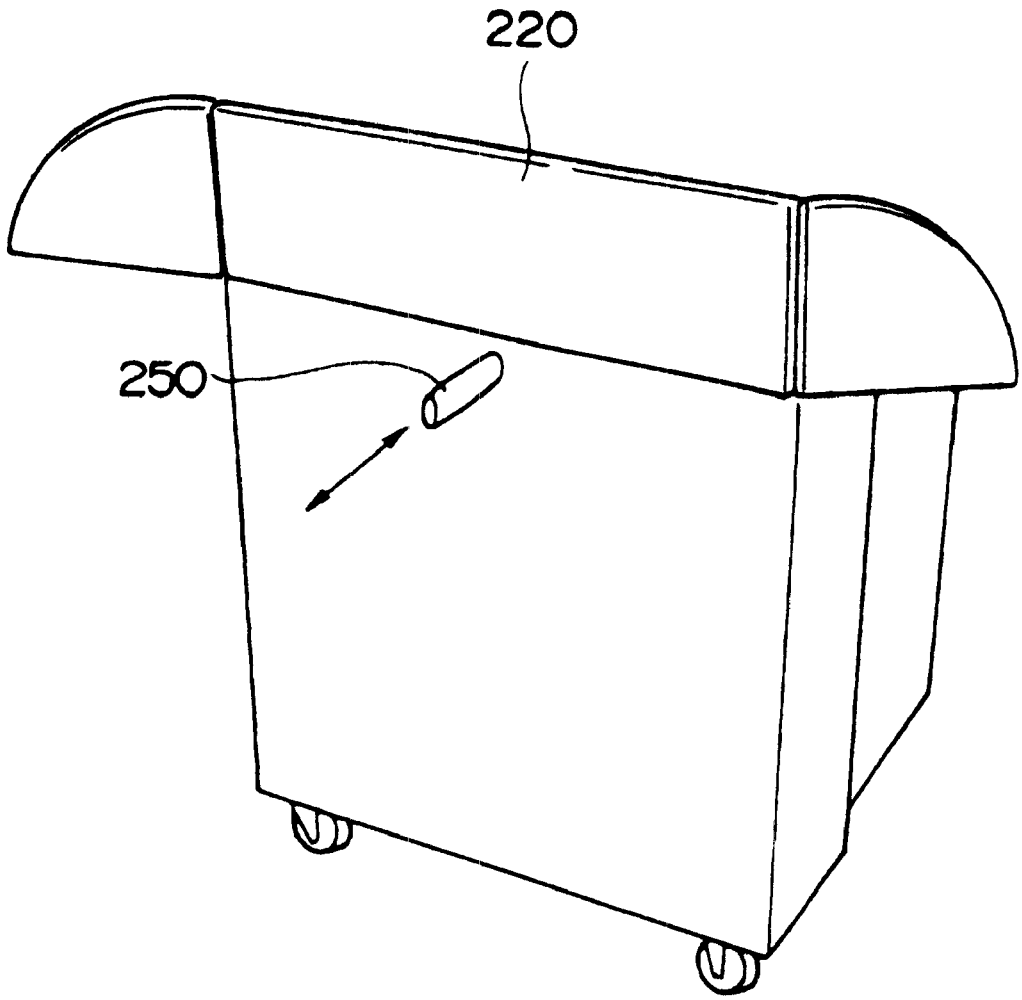
FIG. 8 is an overall view of another embodiment of a utility mechanism supporting device.

The cases where the counter boards are supported by the front and rear doors are explained. However, as is shown in FIG. 8, a composition of providing a supporting post 250 for a counter board 220 so as to be projected to the sidewall surface of the meal service cart main body is also possible.

The meal service cart according to the present invention could form a utility space while satisfying the regulations of the flightworthy examination procedure of an aircraft, as well as without decreasing the passenger seats or increasing the overall weight.

I claim:

1. An in-flight meal service cart including a box-shaped main body formed from at least a front and a rear door, two side wall boards, a ceiling board and a bottom board, and a plurality of wheels for transportation, and forming a storage space inside the box-shaped main body, wherein said box-shaped main body further includes a rotatable utility mechanism, said utility mechanism is provided movably between a position of being stored to the main body and a rotated position of being perpendicular to the side wall board, and said box-shaped main body is provided with a supporting means for supporting said utility mechanism in a horizontal condition when said utility mechanism is in a position of being perpendicular to the side wall board; and wherein each said side wall board of said box-shaped main body is comprised of two boards forming a gap therebetween, and said utility mechanism is configured to be insertable into said gap of the side wall boards.

2. An in-flight meal service cart according to claim 1, wherein said utility mechanism is a counter member.

3. An in-flight meal service cart according to claim 1, wherein outer surfaces of said box-shaped main body and outer surfaces of said utility mechanism being exposed during an equipped position are formed from a special fireproof material, and outer wall surfaces of said meal service cart disclose a special fireproof material.

4. An in-flight meal service cart including a box-shaped main body formed from at least a front and a rear door, two side wall boards, a ceiling board and a bottom board, and a plurality of wheels for transportation, and forming a storage space inside the box-shaped main body, wherein said box-shaped main body further includes a rotatable utility mechanism, said utility mechanism is rotatively attached to said main body to be rotatable between a position of being stored to the main body and a rotated position of being perpendicular to the side wall board, and said box-shaped main body is provided with a supporting means for supporting said utility mechanism in a horizontal condition when said utility mechanism is in a position of being perpendicular to the side wall board; and wherein said supporting means of the utility mechanism are said front and rear doors, and said utility mechanism is supported in a horizontal condition by said front and rear doors being in an opened position, when said utility mechanism is rotated to a position of being perpendicular to said side wall board.

5. An in-flight meal service cart according to claim 4, wherein said utility mechanism is equipped on top of said ceiling board of said box-shaped main body.

6. An in-flight meal service cart according to claim 4, wherein said utility mechanism is equipped on top of said ceiling board of said box-shaped main body.

7. An in-flight meal service cart according to claim 4, wherein said utility mechanism is a counter member.

8. An in-flight meal service cart according to claim 4, wherein outer surfaces of said box-shaped main body and outer surfaces of said utility mechanism being exposed during an equipped position are formed from a special fireproof material, and outer wall surfaces of said meal service cart disclose a special fireproof material.

* * * * *